US006512336B2

(12) United States Patent
De Zwart et al.

(10) Patent No.: US 6,512,336 B2
(45) Date of Patent: Jan. 28, 2003

(54) PLASMA DISPLAY PANEL ELECTRODE STRUCTURE AND METHOD OF DRIVING A PLASMA DISPLAY PANEL

(75) Inventors: Siebe Tjerk De Zwart, Eindhoven (NL); Antonius Hendricus Maria Holtslag, Eindhoven (NL); Gerhard Spekowius, Roetgen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/954,650

(22) Filed: Sep. 18, 2001

(65) Prior Publication Data

US 2002/0047592 A1 Apr. 25, 2002

(30) Foreign Application Priority Data

Sep. 21, 2000 (EP) ..... 00203284

(51) Int. Cl.[7] ..... G09G 3/10
(52) U.S. Cl. ..... 315/169.3; 315/169.4
(58) Field of Search ..... 315/169.3, 169.4, 315/169.1; 345/60, 66, 67, 68, 55; 313/306, 309, 336, 351

(56) References Cited

U.S. PATENT DOCUMENTS 6,104,361 A * 8/2000 Rutherford ..... 345/55
6,288,691 B1 * 9/2001 Mikoshiba et al. ..... 315/169.1
6,288,693 B1 * 9/2001 Song et al. ..... 345/209
6,448,947 B1 * 9/2002 Nagai ..... 345/60

FOREIGN PATENT DOCUMENTS

EP 0762373 3/1997 ..... G09G/3/28
EP 0938072 A1 8/1999 ..... G09G/3/28

OTHER PUBLICATIONS

Patent Abstracts Of Japan, Yanagida Kazuaki, "Color Display Panel," Publication No. 2000123748, Apr. 28, 2000, Application No. 10309553, Oct. 16, 1998.
Patent Abstracts Of Japan, Kosaka Tadayoshi, "Plasma Display Panel," Publication No. 20000223033, Aug. 11, 2000, Application No. 11025728, Feb. 3, 1999.
Patent Abstracts Of Japan, Inanaga Yasutaka, "Method For Driving Alternating–Current Type Plasma Display Panel, Plasma Display Device, And Alternating–Current Type Plasma Display Panel," Publication No. 2000298451, Oct. 24, 2000, Application No. 11106439, Apr. 14, 1999.

* cited by examiner

*Primary Examiner*—Don Wong
*Assistant Examiner*—Chuc Tran

(57) ABSTRACT

The invention relates to an AC plasma display panel (12) of the surface discharge type, and more specifically to the structure of the address electrodes (5) of said panel, and to a method of driving said panel. According to the invention, only one address electrode (5) is used for one out of every two columns. Scan (8) and common (7) electrodes may comprise transparent parts (11). These parts (11) may extend over one out every two cells, in a checkerboard fashion. In a preferred embodiment as shown in FIG. 7, the columns may have alternating wide (15) and narrow (16) cells (2). In the driving method according to the invention, all rows are addressed during an addressing phase, and subsequently all rows are simultaneously sustained during a sustain phase.

13 Claims, 8 Drawing Sheets

PLASMA DISPLAY PANEL ELECTRODE STRUCTURE AND METHOD OF DRIVING A PLASMA DISPLAY PANEL

FIELD OF THE INVENTION

The invention relates to a plasma display panel as defined in the precharacterizing part of claim 1, and more specifically to the electrode structure thereof. The invention also relates to a method of driving a plasma display panel as defined in the precharacterizing part of claim 13.

The invention applies to an AC plasma display panel of the surface discharge type.

BACKGROUND OF THE INVENTION

Plasma display panels and methods of driving same are known in the art. Plasma display panels are matrix devices comprising individual cells defined by the intersection of rows and columns. The structure of a panel 1 known from EP 0 762 373 is shown schematically in FIG. 1 in a front view. FIGS. 2*a* and 2*b* are a detailed perspective and a side view, respectively, of a single cell 2. The panel comprises a front plate 3 made of transparent material and a back plate 4. A first set of parallel address electrodes 5 a1, a2, a3, . . . an . . . are located in a vertical direction on the back plate. Barrier ribs 6, located parallel to the address electrodes 5, also on the back plate 4, perform the function of separating cells 2 from neighbouring columns. A second set of electrodes comprises common electrodes 7 and scan electrodes 8. These electrodes are located on a front plate 3, facing the address electrodes 5 on the back plate 4. The common electrodes 7 are divided into two groups, c1 and c2. The scan electrodes 8 s1, s2, s3 . . . are separately addressable. Said second set of electrodes is oriented in a horizontal direction, substantially orthogonal to the address electrodes 5. Phosphors 9 deposited on the back plate 4 perform the function of converting the ultraviolet light UV produced by a gas discharge GD between a common electrode 7 and a scan electrode 8 into visible light VL. By selecting different types of phosphors 9, one produces light of the desired colour, e.g. red, green, blue.

Common and scan electrodes known in the art may be formed of a metallic part 10 and a transparent part 11. The metallic part 10 ensures the conduction of the current flowing through the electrode. The transparent part 11 extends the voltages applied to the electrode across the desired areas of the cells 2. The transparent parts 11 may be made of a thin layer of metal oxides (ITO).

When displaying successive picture frames on such a plasma display panel 1, a frame is divided into an odd field and a subsequent, even field. Odd rows, i.e. rows between electrodes c1 and s1, c2 and s2, c1 and s3 in FIG. 1, produce light during an odd field, and even rows, i.e. rows between electrodes s1 and c2, s2 and c1 in FIG. 1, produce light during an even field. A drawback of this (interlacing) method is that alternation of the odd and even fields causes line flicker and a reduction of image quality. The driving scheme requires the common electrodes to be grouped in two interleaved sets, the c1 common electrodes and the c2 common electrodes.

In known plasma display panels, each column requires one address electrode. A VGA display, with 640 columns, requires 1920 address electrodes (one for each colour). Increasing the picture resolution by adding columns further increases the number of address electrodes and therefore the cost of the panel and the associated driving electronics.

SUMMARY OF THE INVENTION

It is an object of the invention to provide a plasma display panel with a reduced number of electrodes. It is also an object of the invention to provide a method of driving a plasma display panel according to the invention, having a good image quality.

The invention provides a plasma display panel as defined in claim 1, in which an address electrode extends over more than one column, covering at least a part of a cell in a first column in one row, and at least a part of a cell in another column in the row immediately below, no other address electrode extending over the cell immediately below the first cell, nor over the cell immediately above the second cell. The amount of address electrodes is thereby reduced by half with respect to a plasma display panel of the known type. The plasma display panel appears as a checkerboard, where one cell out of every two cells is addressable.

In a preferred embodiment as defined in claim 2, the common and scan electrodes comprise a metal part and a set of transparent parts. These transparent parts are formed in such a way as to allow discharges in one out of every two cells of the panel, in a checkerboard fashion.

The transparent parts may be made of areas of a thin layer of metal oxide (ITO). In a preferred embodiment as defined in claim 3, the common and scan electrodes have transparent parts made of areas of a thin metal grid. This has the advantage that the production of the metallic part and the transparent parts of an electrode may by performed in a single process step.

The address electrodes defined in claim 4, formed as straight strips underneath one out of every two barrier ribs, are especially easy to produce, and are robust. The layout of the transparent parts in a checkerboard fashion ensures that only the desired cells produce light.

The zigzag address electrodes defined in claim 5 may reach cells in adjacent columns in each successive row, while remaining thin. Thin electrodes have the advantage of a reduced capacity and therefore require less power. The period of the zigzag electrodes may encompass two or more rows. The address electrodes defined in claim 5 may even be formed in diagonals across the whole height of the panel. Zigzag electrodes defined in claim 5 have the additional advantage that they only cover cells where a discharge is desired, thereby reducing the risk of spurious discharges.

As claimed in claim the transparent parts of common and scan electrodes may, 6, extend slightly over the cell immediately above, or below, in the same column. The discharge space is thereby extended further in the vertical direction. This increases the part of the surface of the panel that produces light, and thereby increases the brightness.

As defined in claim 7, the transparent parts may extend over only part of the width of a cell. The capacity of the electrodes is thereby reduced, and the currents required to drive the panel are reduced accordingly. As defined in claim 8, the transparent parts may have a wider portion near said gap. This improves the quality of a discharge occurring between said pair of transparent parts.

As defined in claim 9, the said two transparent parts may, extend side by side, the gap between said two transparent parts extending vertically over said cell. The surface gas discharge between said two transparent parts occurs over an increased gap length and is thereby improved.

As defined in claim 10, the address electrodes may, comprise an extension extending substantially over the gap. This extension increases the coverage of the address electrodes to the desired cells. These extensions may be applied to the straight address electrodes defined in claim 4 as well as to the zigzag address electrodes of claim 5.

In a preferred embodiment as defined in claim 11, the barrier ribs have a shape forming enlarged cells where these are used for producing light, and cells of reduced width where these remain unlit. The ratio of light producing area to unlit area is thereby increased, and the brightness of the panel is significantly improved. Address electrodes in this embodiment may be of the straight type or of the zigzag type. The cells of reduced width may be reduced to nil or nearly nil area.

In the embodiment defined in claim 11, the transparent parts of the common and scan electrodes may be formed as continuous strips as defined in claim 12. The production cost of the panel is thereby reduced. No precise alignment in the horizontal direction of the front plate with respect to the back plate is necessary.

The invention also provides a method of driving a plasma display panel according to the invention, comprising the steps of (a) performing a whole-screen write discharge and self-erasing discharge;

(b) performing an addressing of all rows of the panel by applying negative pulses to odd scan electrodes S1, S3, . . . and simultaneously positive pulses to common electrodes C1, and negative pulses to even scan electrodes S2,S4 . . . and simultaneously positive pulses to common electrodes C2, for selecting odd rows, by applying negative pulses to odd scan electrodes S1,S3, . . . and simultaneously positive pulses to common electrodes C2, and negative pulses to even scan electrodes S2,S4 . . . and simultaneously positive pulses to common electrodes C1, for selecting even rows, and by applying a positive pulse to the address electrodes of the columns where a cell is to be lit in the selected row, thereby priming the cells to be lit;

(c) performing a sustain discharge in all cells of the panel that have been primed in the addressing step by supplying positive pulses to all common electrodes C1, C2, and, in counterphase thereto, positive pulses to all scan electrodes S1,S2, . . . Sn.

Step a can be done, for example, by applying voltage pulses to common electrodes C1 and C2 and to address electrodes A1 . . . An During the address phase, the rows of the panel may be addressed in any order, provided that all rows are eventually addressed. The driving method according to the invention has the advantage that, during the sustain phase, all rows of the panel are simultaneously driven, whereas in the prior art, odd rows are driven during the odd fields, and even rows are driven during the even fields. An advantage of the present invention is that line flicker due to interlacing is avoided and the image quality is correspondingly improved.

These and other aspects of the invention are apparent from and will be elucidated with reference to the embodiments described hereinafter.

DETAILED DESCRIPTION OF PREFERRED EMBODIMENTS

Figure 1:
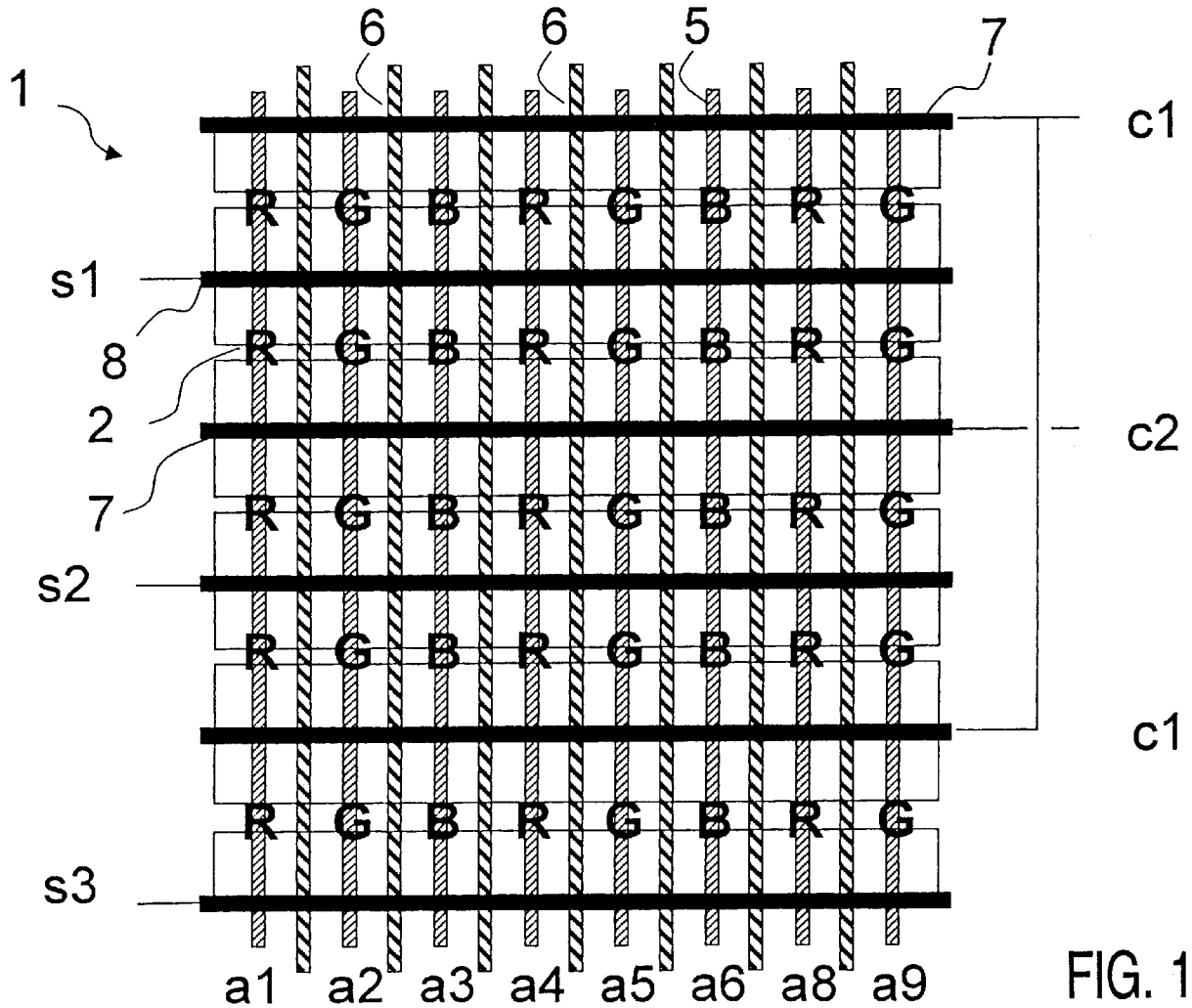
FIG. 1 is a front view of a plasma display panel known in the prior art.
Figure 2A:
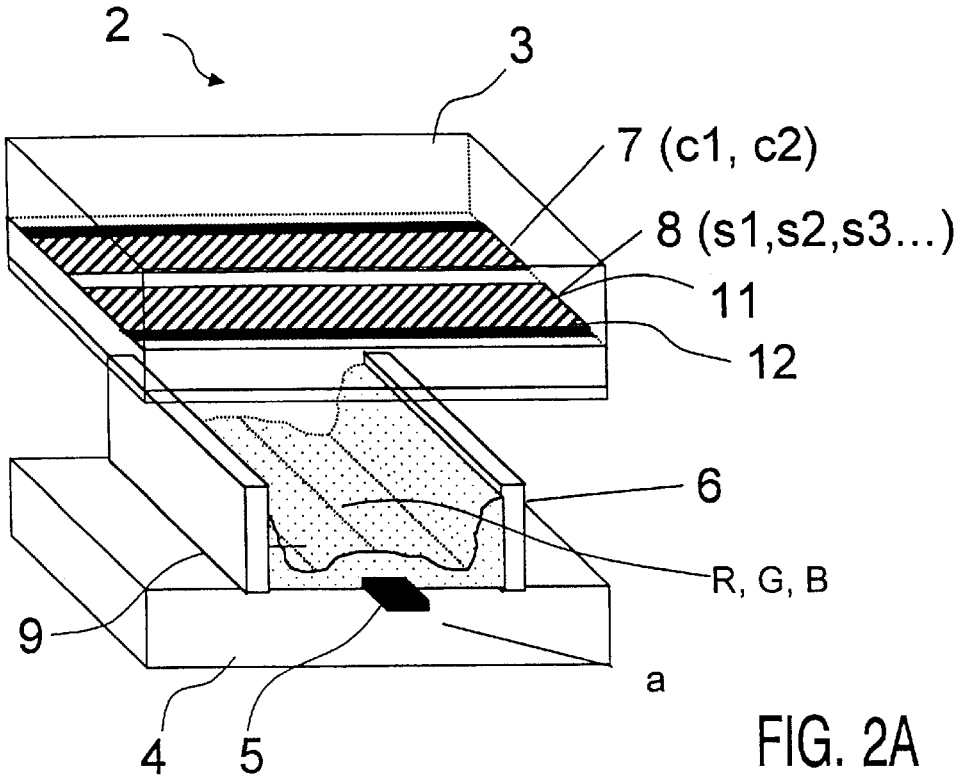
FIGS. 2A and 2B are a perspective and a side view, respectively, of a single cell of a plasma display panel known in the prior art.
Figure 2B:
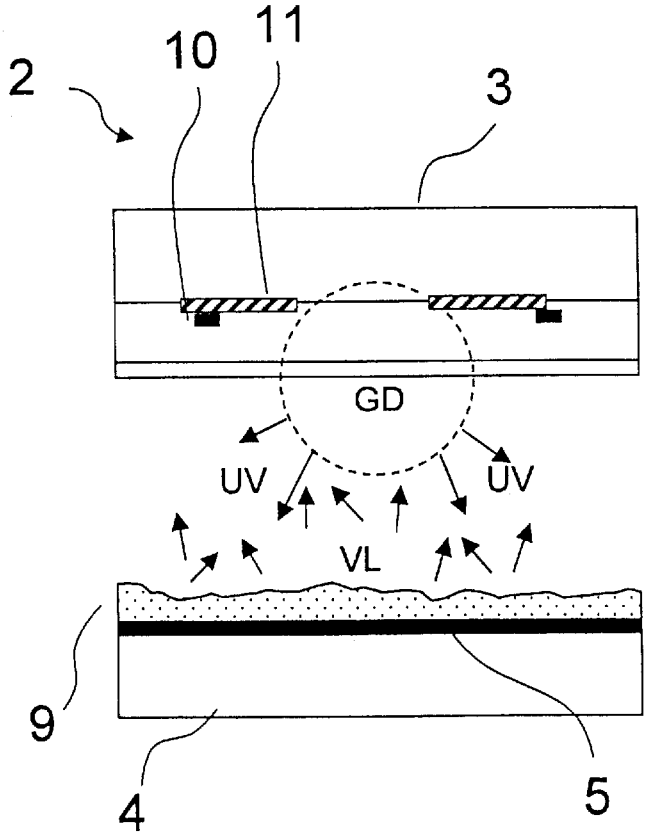
Figure 3:
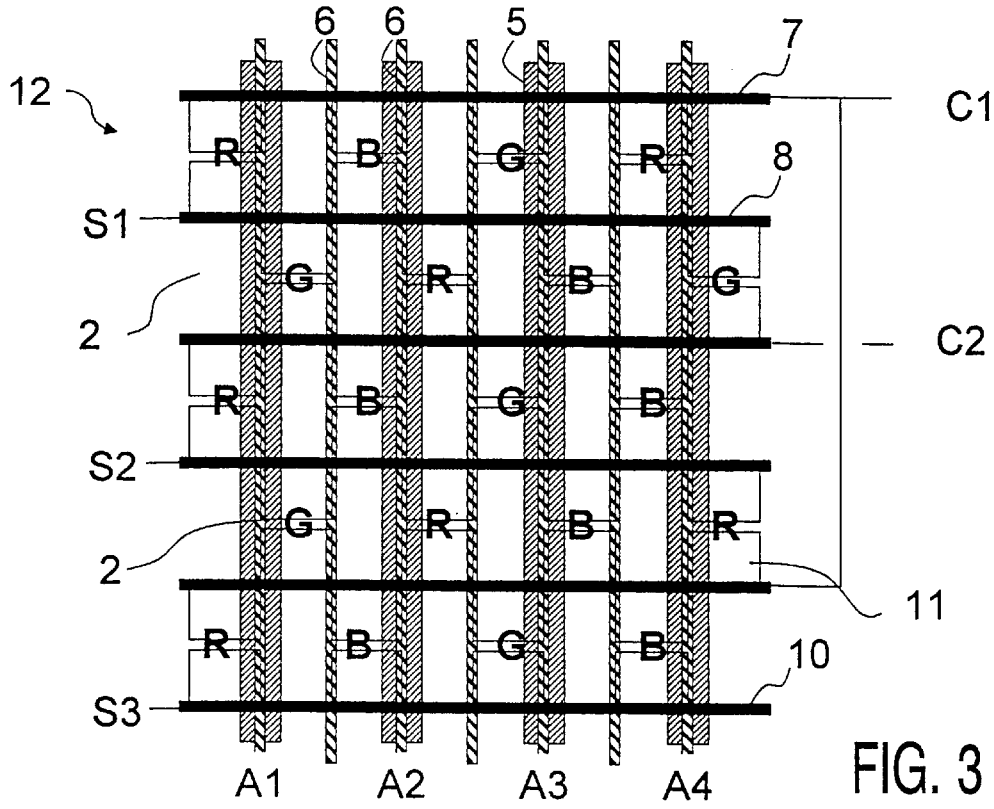
FIG. 3 is a front view of a plasma display panel according to the invention.

An embodiment of a plasma display panel according to the invention 12 is shown in FIG. 3. Common electrodes 7 C1, C2, and, alternately therewith, scan electrodes 8 S1,S2, S3 extend in a horizontal direction. Address electrodes 5 A1, A2, A3 are formed as strips on the back plate for one out of every two columns. Barrier ribs 6 are formed on the back plate, one out of every two barrier ribs 6 being formed above an address electrode 5. The widths of the address electrodes 5 and of the barrier ribs 6 are such that an address electrode 5 A1 . . . A4 appears on both sides of the barrier rib 6. Common 7 and scan 8 electrodes comprise transparent parts 11 extending over one out of every two cells, in a checkerboard fashion. The voltage applied to an address electrode 5 during the addressing phase is thus applied to two neighbouring cells of a row being scanned. The transparent parts of the common 7 and scan electrodes 8 being scanned ensure that a write discharge only occurs in the cell being covered by transparent parts 11, and not in the neighbouring cell. The address electrode 5 A1 of FIG. 3 may be considered as the fusion of address electrodes 5 a1 and a2 of FIG. 1, A2 resulting from a3,a4 etc . . . . The voltage to be applied to electrode A1 is the one applied to al during the scanning of odd rows, and the one applied to a2 during the scanning of even rows.

Figure 4:
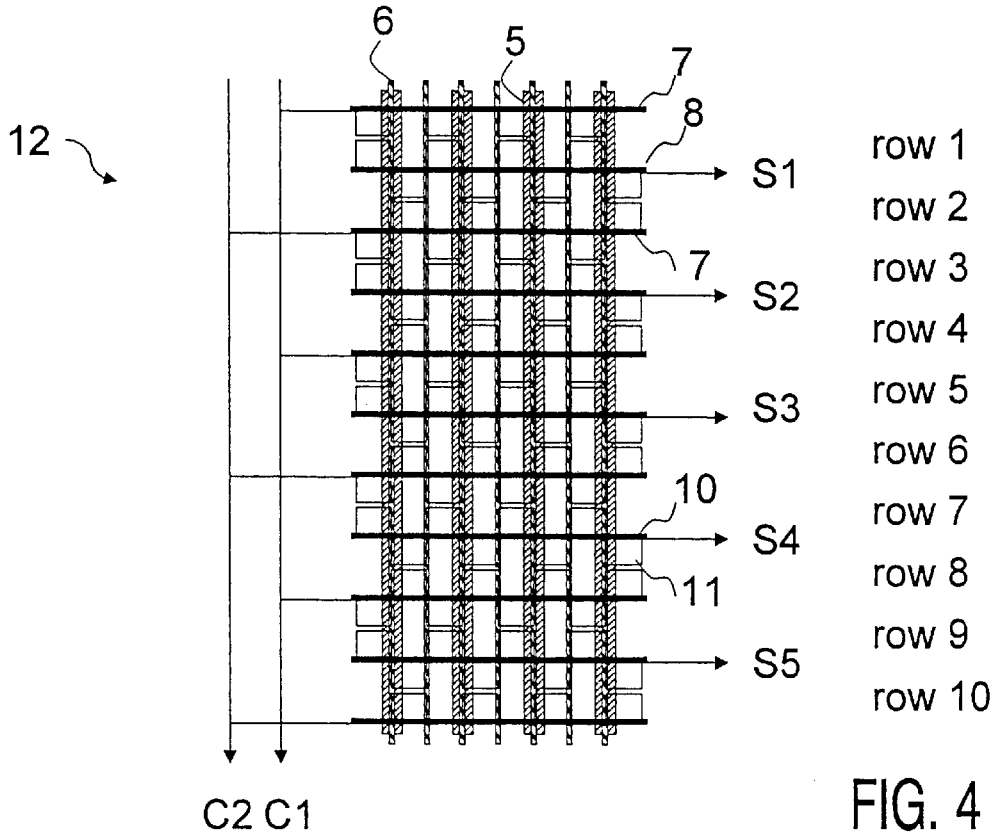
FIG. 4 is a front view of same plasma display panel showing how common electrodes are grouped.

FIG. 4 shows how odd common electrodes 7 C1 are connected to a single driver, and the even common electrodes 7 C2 are connected to another single driver. Each scan electrode 8 S1,S2,S3,S4,S5 is connected to a single driver.

Figures 5A, 5B, 5C, 5D, 5E, 5F, 5G:
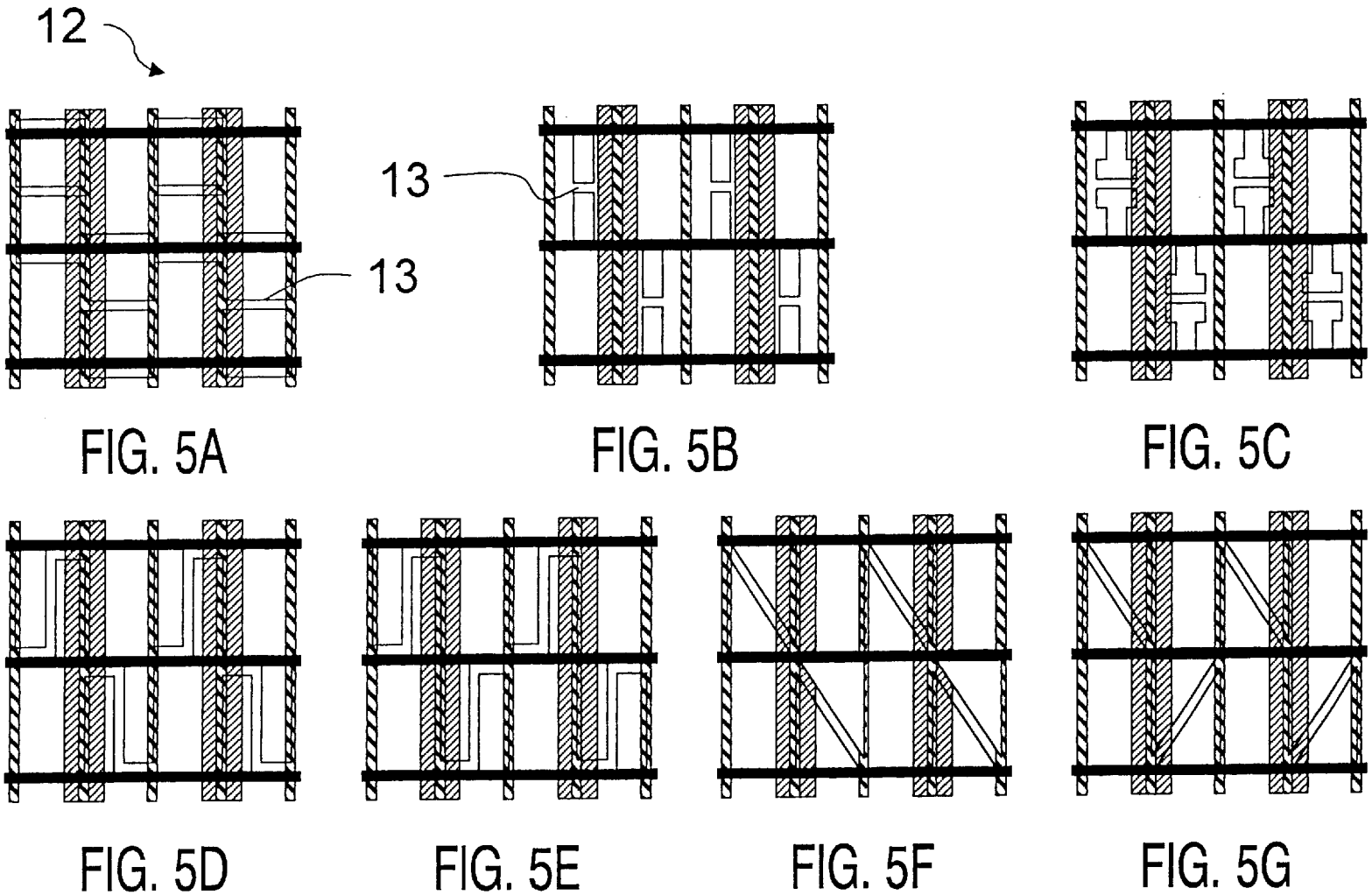
FIGS. 5A to 5G are front views of plasma display panels according to the invention showing different embodiments of the transparent parts of the scan and common electrodes.

FIGS. 5A to 5G show different possible realisation of the transparent parts 11 of the electrodes in a plasma display panel according to the invention. In the realisation of FIG. 5*a,* the transparent parts 11 extend partly over the cell immediately above or below. The light-producing area is thereby enlarged, and the brightness is improved.

FIGS. 5B to 5E show embodiments where the address electrodes 5 extend over only part of the width of a cell. In FIG. 5C, the narrow address electrodes 5 have a wider part near the gap 13. All embodiments shown in FIGS. 5D to 5G allow an increase of the length of the gap 13. The surface gas discharge between scan 8 and common 7 electrodes is thereby improved.

Figures 6A, 6B, 6C:
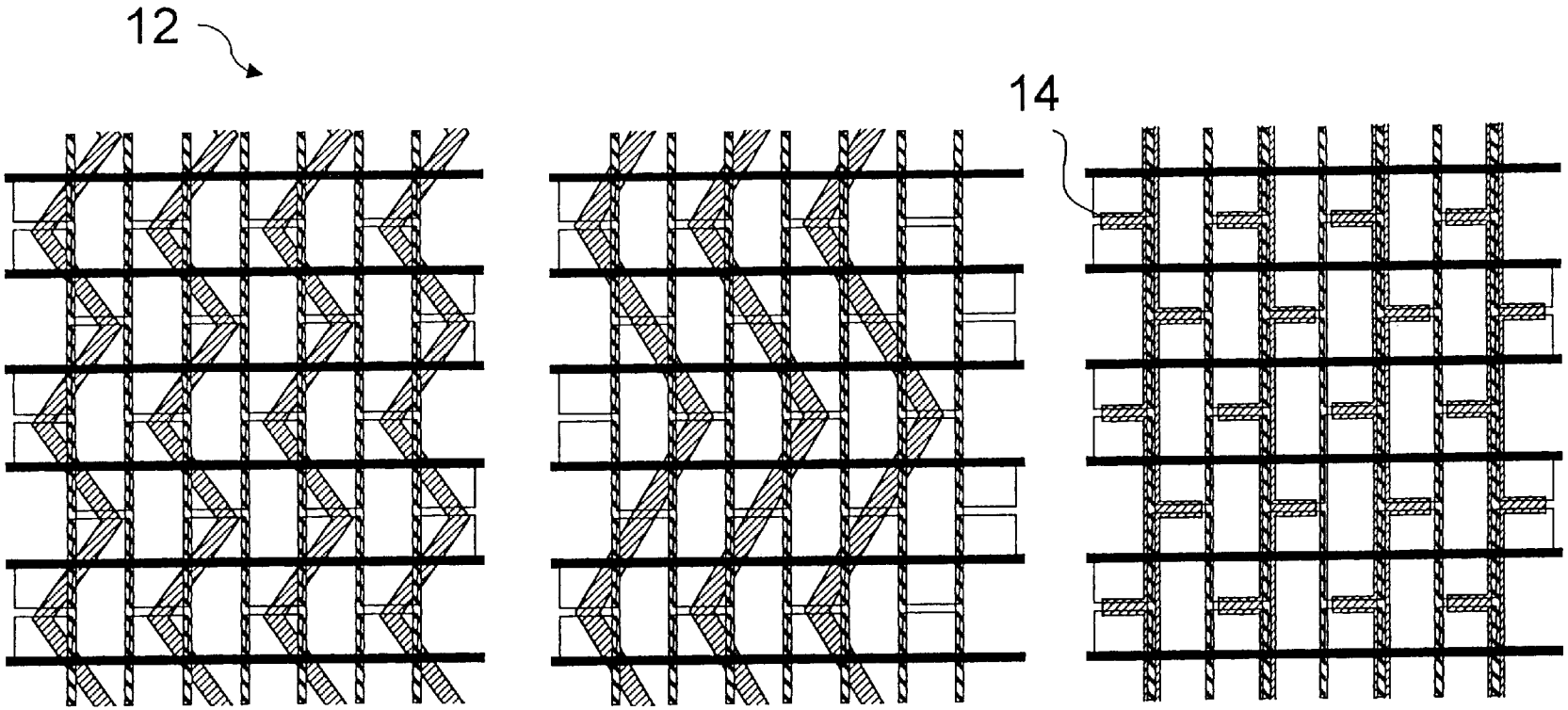
FIGS. 6A and 6B are front views of plasma display panels according to the invention, where address electrodes are of the zigzag type.
FIG. 6C is a front view of a plasma display panel according to the invention where the address electrodes have extensions.

FIGS. 6A and 6B show embodiments wherein the address electrodes 5 are formed as a zigzag. In FIG. 6A, the vertical periodicity of the zigzag is two rows, whereas in FIG. 6B, it is four rows. Other realisations are possible, including the case where the address electrodes 5 are straight lines extending diagonally from the top to the bottom of the panel, provided that one out of every two cells of the panel is traversed by an address electrode 5, in a checkerboard fashion.

In FIG. 6C, the address electrodes 5 comprise extensions 14. These extensions 14 partly cover the one out of every two cells with transparent parts 11, and preferably the gap 13 area between the two transparent parts 11. The principal part of the address electrodes 5 may then be narrower and even be completely covered by the barrier ribs 6.

Figure 7:
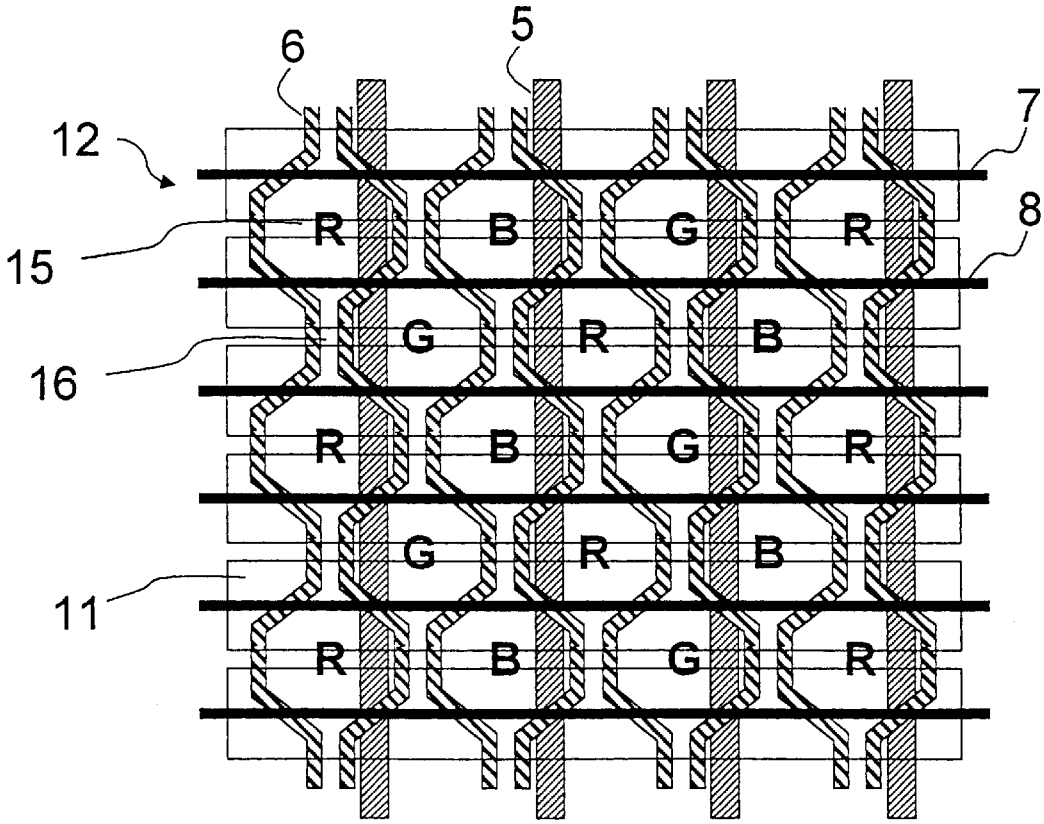
FIG. 7 is a front view of a plasma display panel according to a preferred embodiment of the invention.

FIG. 7 shows a preferred embodiment of the invention. The barrier ribs 6 are formed in such a shape that the columns have widths varying between a first width and a second width. Odd columns have the larger width 15 over odd rows, and the smaller width 16 over even rows, and even columns have the larger width over even rows, and the smaller width over odd rows. This gives the panel 12 the overall structure of a honeycomb. Address electrodes 5 are straight vertical strips. The larger column width, the smaller column width and the width of the address electrodes 5 are such that only the cells where light production is desired are partly covered by the address electrodes 5. The narrower cells are not covered by an address electrode 5. The transparent parts 11 may then extend also over cells where no light production is desired and be formed as simple straight strips along the length of the scan and common electrodes. This embodiment has the advantage of a much improved brightness. The common and scan electrodes may also be formed of a set of horizontal thin lines linked by vertical lines, thereby forming strips of a metallic thin grid.

Figure 8:
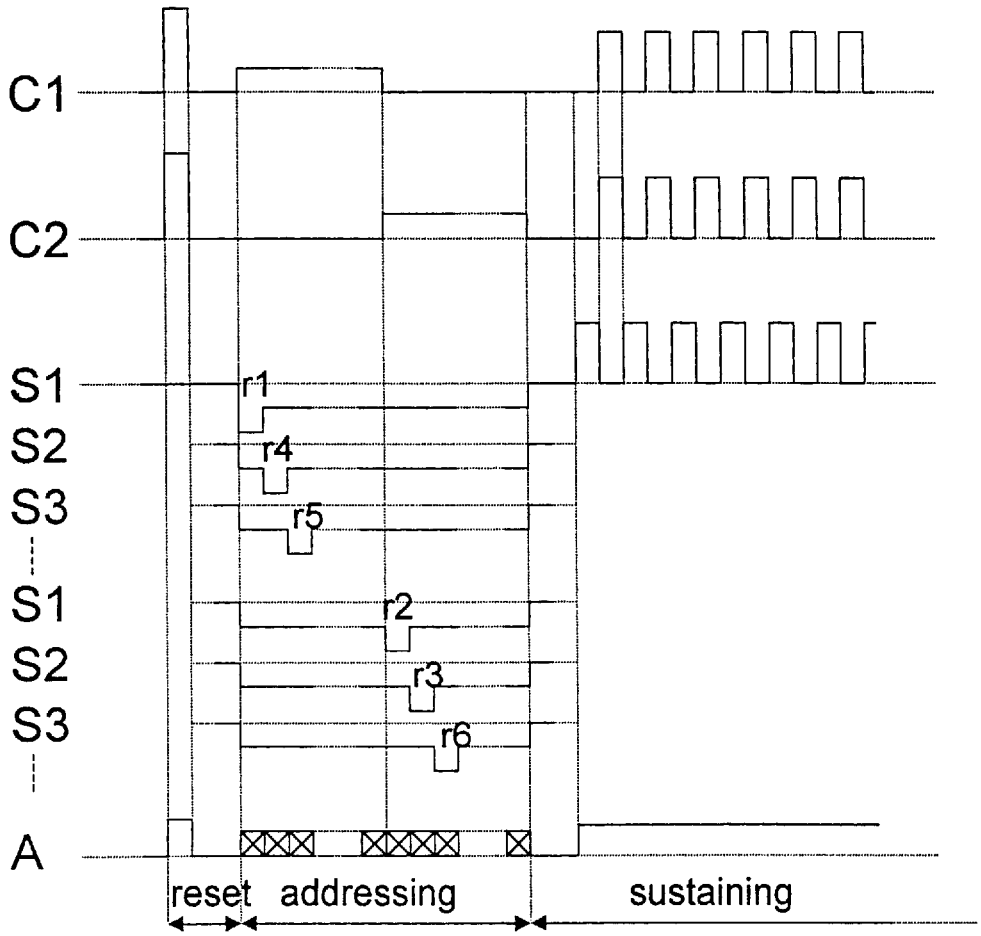
FIGS. 8 and 9 are waveform diagrams of voltages applied to electrodes for illustrating two embodiments of the driving method according to the invention.
Figure 9:
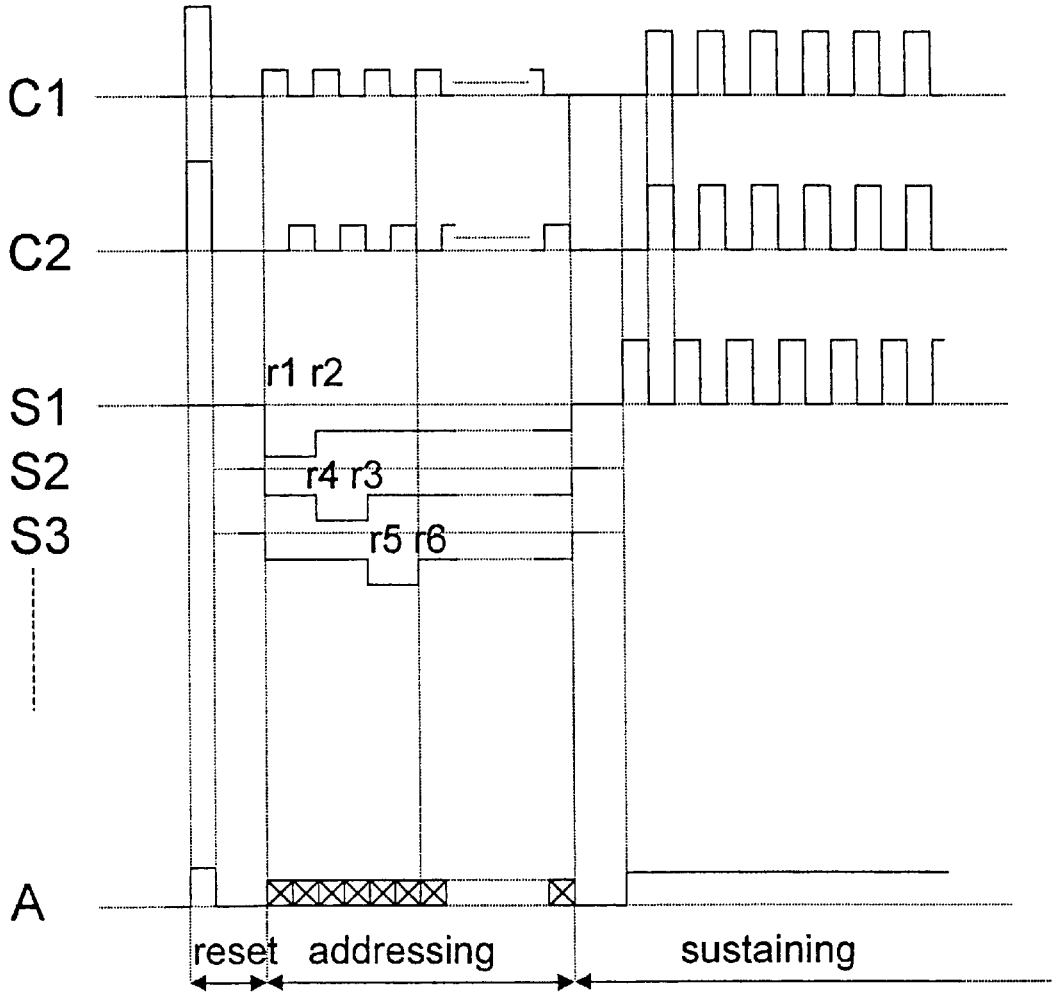

Although the plasma display panel according to the invention may be driven in accordance with any of the methods known from EP 0 762 373, a much improved method applies to the panel of the invention. FIGS. 8 and 9 show two embodiments of said method and display voltage levels applied to electrodes, as a function of time. During a reset phase, the whole area of the panel is discharged, as in the known method. During the addressing phase, a row is selected by applying a positive voltage to the applicable common electrode (C1 or C2) and a negative voltage to a selected scan electrode. FIG. 8 shows e.g. that row 1 is being selected when C1 is positive and S1 is negative. A row being selected, a positive voltage is applied to the address electrodes 5 of the columns where a cell is to be lit in the selected row, and a zero voltage elsewhere. This is shown by a crossed square in FIGS. 8 and 9. All rows of the panel are eventually addressed during the addressing phase. After all the rows have been addressed, the sustain is performed by supplying positive pulses to both common electrodes 7 C1, C2, and, in counterphase thereto, positive pulses to all scan electrodes 8 S1,S2, . . . Sn driven together. All rows of the panel are simultaneously lit.

In the embodiment of FIG. 8, address electrode C1 is positive during the first half of the addressing phase, and scan electrodes S1, S2,S3 . . . are successively addressed, thereby successively selecting row 1, row 4, row 5 During the second half of the addressing phase, address electrode C2 is positive and scan electrodes S1,S2,S3 . . . are successively addressed, thereby successively selecting row 2, row 3, row 6 . . . . In this embodiment, the common electrodes are switched only once during the addressing phase, requiring less power for driving said electrodes.

Other embodiments are possible, in which the rows are scanned in a different order. Reset and sustain phases are identical in these embodiments. FIG. 9 shows an embodiment where a wider pulse is applied to scan electrode S1, selecting successively rows 1 and row 2, then to scan electrode S2, selecting successively rows 4 and row 3, etc . . .

When applying the invention to a RGB display, a pixel, i.e. the combination of a red cell, a green cell, and a blue cell, has the shape of a triangle. As can be seen in FIG. 3, when considering a pair of rows, one finds a first RGB triangle having the top down, followed by an adjacent triangle having the top up. This gives the so-called delta-nabla structure. When using the driving method of the invention, where all rows are driven simultaneously during sustain, the panel of the invention gives a much improved resolution, when compared with the prior-art panel, where (see FIG. 1), pixels are formed by three cells in line, and where, during the sustain phase, even rows remain unlit during odd fields, and odd rows remain unlit during even fields.

While the invention has been described in connection with preferred embodiments, it will be understood that modifications thereof within the principles outlined above will be evident to those skilled in the art, and thus the invention is not limited to the preferred embodiments but is intended to encompass such modifications. The horizontal and vertical directions may be interchanged. Although the invention has been described with reference to a colour display using three colours (red, green blue), the invention may be applied to displays using other colour combinations, or more or fewer colours, including monochrome displays. For the sake of clarity, the drawings show a limited number of rows and columns. The invention, however, applies to plasma display panels having larger numbers of rows and columns. The voltage levels described with reference to FIGS. 8 and 9 may be reversed.

REFERENCES TO FIGURES

1. Plasma display panel known in the prior art
2. Cell
3. Front plate
4. Back plate
5. Address electrode
6. Barrier rib
7. Common (X) electrode
8. Scan (Y) electrode
9. Phosphor
10. Metallic part
11. Transparent part
12. Plasma display panel according to the invention
13. Gap
14. Extension
15. Cell with larger width
16. Cell with reduced width

What is claimed is:

1. A plasma display panel (12) comprising a first substrate (3), having, formed thereon, a set of common electrodes (7) grouped in two interleaved sets C1 and C2, extending along a horizontal direction, and, alternately with said common electrodes (7), a set of scan electrodes (8) S1 to Sn extending along the same direction, the space delimited between a common electrode (7) and scan electrode (8) defining a row, and a second substrate (4) parallel to said first substrate, having, formed thereon, a set of address electrodes (5) and a set of barrier ribs (6), both set up substantially perpendicular to said horizontal direction, the space delimited by a pair of adjacent barrier ribs (6) defining a column, the space at the intersection of a row and a column defining a cell, characterized in that an address electrode (5) extends over more than one column, covering at least a part of a first cell in a first column in one row, and at least a part of a second cell in a second column in the row immediately below, no other address electrode (5) extending over the cell immediately below the first cell, no other address electrode (5) extending over the cell immediately above the second cell.

2. A plasma display panel (12) as claimed in claim 1, characterized in that the common electrodes (7) and the scan electrodes (8) comprise a metal part (10) and a set of transparent parts (11), each transparent part (11) extending on one side of corresponding metal part (10), a transparent part (11) of a common electrode (7) and a transparent part (11) of an adjacent scan electrode (8) extending towards each other over one out of every two cells, in a checkerboard fashion, a gap (13) remaining between said two transparent parts (11), said one out of every two cells being covered by an address electrode (5).

3. A plasma display panel (12) as claimed in claim 2, characterized in that said transparent parts (11) are made of a metallic grid.

4. A plasma display panel (12) as claimed in claim 2, characterized in that the address electrodes are straight strips, formed underneath a barrier rib (6) separating two adjacent columns.

5. A plasma display panel (12) as claimed in claim 2, characterized in that the transparent parts (11) extend over the other side of said metal part (10).

6. A plasma display panel (12) as claimed in claim 2, characterized in that the transparent parts (11) extend over only part of the width of a cell.

7. A plasma display panel (12) as claimed in claim 6, characterized in that the transparent parts (11) have a wider portion near said gap (13).

8. A plasma display panel (12) as claimed in claim 6, characterized in that said two transparent parts (11) extend side by side, the gap (13) between said two transparent parts (11) extending vertically over said cell.

9. A plasma display panel (12) as claimed in claim 2, characterized in that the address electrodes (5) comprise an extension (14) extending substantially over the gap (13).

10. A plasma display panel (12) as claimed in claim 1, characterized in that the address electrodes (5) are formed in a zigzag shape.

11. A plasma display panel (12) as claimed in claim 1, characterized in that said barrier ribs (6) have a zigzag configuration, such that the width of a column varies between a first width and a second width, a first column having the larger width over even rows and the smaller width over odd rows, a column adjacent to said first column having the larger width over odd rows and the smaller width over even rows.

12. A plasma display panel (12) as claimed in claim 11, characterized in that said transparent parts (11) are strips extending along the length of corresponding metallic part (10).

13. A method of driving a plasma display panel as claimed in claim 1, wherein the space delimited between a common electrode (7) Ci and a scan electrodes (8) Sj immediately below defines an odd row, and the space delimited between a common electrode (7) Ci and a scan electrode (8) Sj immediately above defines an even row, characterized in that it comprises the steps of (a) performing a whole-screen write discharge and self-erasing discharge by applying voltage pulses to common electrodes (7) C1 and C2 and to address electrodes (5) A1 . . . An;

(b) performing an addressing of all rows of the panel by applying negative pulses to odd scan electrodes (8) S1,S3, . . . and simultaneously positive pulses to common electrodes (7) C1, and negative pulses to even scan electrodes (8) S2,S4 . . . and simultaneously positive pulses to common electrodes (7) C2, for selecting odd rows, by applying negative pulses to odd scan electrodes (8) S1,S3, . . . and simultaneously positive pulses to common electrodes (7) C2, and negative pulses to even scan (8) electrodes S2,S4 . . . and simultaneously positive pulses to common electrodes (7) C1, for selecting even rows, and by applying a positive pulse to the address electrodes (5) of the columns where a cell is to be lit in the selected row, thereby priming the cells to be lit;

(c) performing a sustain discharge in all cells of the panel that have been primed in the addressing step by supplying positive pulses to both common electrodes (7) C1, C2, and, in counterphase thereto, positive pulses to all scan electrodes (8) S1,S2, . . . Sn.

* * * * *